US010464727B1

(12) United States Patent
Rerecich et al.

(10) Patent No.: US 10,464,727 B1
(45) Date of Patent: Nov. 5, 2019

(54) BUOYANT ARTICLE CARRIER

(71) Applicant: L & G Products, LLC, Denver, NC (US)

(72) Inventors: Lisbeth A. Rerecich, Denver, NC (US); George S. Schmitt, Denver, NC (US)

(73) Assignee: L & G Products, LLC, Denver, NC (US)

( * ) Notice: Subject to any disclaimer, the term of this patent is extended or adjusted under 35 U.S.C. 154(b) by 0 days.

(21) Appl. No.: 16/295,315

(22) Filed: Mar. 7, 2019

(51) Int. Cl.
*B65D 63/10* (2006.01)
*B65D 63/18* (2006.01)
*A45F 5/10* (2006.01)

(52) U.S. Cl.
CPC ..... *B65D 63/18* (2013.01); *B65D 63/10* (2013.01); *A45F 2005/1086* (2013.01); *B65D 2563/107* (2013.01)

(58) Field of Classification Search
CPC .. B65D 63/10; B65D 63/18; B65D 2563/107; A45F 2005/006; A45F 2005/1013; A45F 2005/1086; A45F 2200/0566; D07B 1/20; A45C 13/30
USPC ..... 294/149–151, 153–157, 165; 441/125
See application file for complete search history.

(56) References Cited

U.S. PATENT DOCUMENTS 4,099,656 A * 7/1978 Neumann ..... A45C 3/00 294/157
4,157,134 A * 6/1979 Stoll ..... A45C 9/00 190/1
4,593,599 A * 6/1986 Yeardley ..... D07B 1/18 294/74
4,854,732 A * 8/1989 Italici ..... A45C 3/00 383/6
5,514,019 A * 5/1996 Smith ..... A41D 13/0007 2/311
5,611,588 A * 3/1997 Mencel ..... A63C 11/02 280/814
5,611,625 A * 3/1997 Legendre ..... A45C 3/001 190/2
5,829,656 A * 11/1998 Reitz ..... B62B 9/26 224/417
5,839,932 A * 11/1998 Pierce ..... B63C 9/1255 441/80
6,637,077 B2 * 10/2003 Doty ..... B60P 3/079 24/298
2008/0227346 A1 * 9/2008 Von Zell ..... B63C 9/115 441/129
2012/0187138 A1 * 7/2012 Vasquez ..... A45C 1/02 220/739

* cited by examiner

*Primary Examiner* — Dean J Kramer
(74) *Attorney, Agent, or Firm* — W. Thad Adams, III; Christina E. Disch; Shumaker, Loop & Kendrick, LLP

(57) ABSTRACT

A carrier for transporting and storing elongate, flexible, buoyant articles having a body having a pre-determined length and a pre-determined width, and adapted to encircle the plurality of buoyant articles, a fastener cooperating with the body for releasably maintaining the body in an encircled position relative to the plurality of the buoyant articles, and a float connected to the body for providing buoyancy to the carrier when not carrying the buoyant articles.

17 Claims, 6 Drawing Sheets

BUOYANT ARTICLE CARRIER

TECHNICAL FIELD AND BACKGROUND OF THE INVENTION

This invention relates to a carrier for elongate buoyant articles. The invention is intended to provide a carrier that enables individuals to carry multiple elongate buoyant articles at once.

A primary example of an elongate buoyant article is a "pool noodle". A typical pool noodle is constructed of polyethylene foam. Due to the buoyancy, they are a common product enjoyed by many individuals in bodies of water such as pools, lakes, rivers, and oceans. A unique feature is that they have a length which is significantly greater than the cross section, and are often flexible. This flexibility in conjunction with the large length to cross section ratio results in difficulty when carrying multiple pool noodles.

In many situations, the pool noodles are being carried over or near a body of water, for example from a dock onto a boat. This situation creates an added difficulty as the individual carrying the pool noodles must manage their own balance while stepping onto or out of a boat. The individual not only has the challenging task of managing multiple pool noodles, but also the risk of dropping all of the pool noodles into the water is increased.

Therefore there is a need for a simple buoyant carrier for multiple pool noodles.

SUMMARY OF THE INVENTION

It is therefore an object of the present invention to provide a carrier for a plurality of elongate, flexible, buoyant articles.

It is another object of the present invention to provide a device for carrying a plurality of elongate, flexible, buoyant articles that is buoyant.

It is another object of the present invention to provide a device for carrying a plurality of elongate, flexible, buoyant articles that has a waterproof storage sleeve.

These and other objects and advantages of the present invention are achieved in the preferred embodiments set forth below by providing a carrier for transporting and storing elongate, flexible, buoyant articles having a body having a pre-determined length and a pre-determined width, and adapted to encircle the plurality of buoyant articles, a fastener cooperating with the body for releasably maintaining the body in an encircled position relative to the plurality of the buoyant articles, and a float connected to the body for providing buoyancy to the carrier when not carrying the buoyant articles.

According to another embodiment of the invention, the float has a width equal to the width of the body.

According to another embodiment of the invention, the pre-determined length is at least twice the pre-determined width.

According to another embodiment of the invention, the float is positioned at a length-wise center of the body.

According to another embodiment of the invention, the float includes a handle positioned on a top side of the float.

According to another embodiment of the invention, the handle is at least partially made of a buoyant material.

According to another embodiment of the invention, the body is a lightweight open mesh for allowing easy water penetration and drainage.

According to another embodiment of the invention, the fastener is an adjustable strap connected to the body.

According to another embodiment of the invention, the fastener is a hook and loop fastener.

According to another embodiment of the invention, the body further comprises a pouch for holding items.

According to another embodiment of the invention, the float further comprises a pouch for holding items.

According to another embodiment of the invention, a carrier is provided for transporting and storing elongate, flexible, buoyant articles having a body having a pre-determined length at least twice a pre-determined width, and adapted to encircle the plurality of buoyant articles, a fastener cooperating with the body for releasably maintaining the body in an encircled position relative to the plurality of the buoyant articles, and a float positioned at a length-wise center of the body, having a width equal to the width of the body, and connected to the body for providing buoyancy to the carrier when not carrying the buoyant articles.

According to another embodiment of the invention, a carrier is provided for transporting and storing elongate, flexible, buoyant articles having a body having a pre-determined length at least twice a pre-determined width, and adapted to encircle the plurality of buoyant articles, a fastener cooperating with the body for releasably maintaining the body in an encircled position relative to the plurality of the buoyant articles, a float positioned at a length-wise center of the body, having a width equal to the width of the body, and connected to the body for providing buoyancy to the carrier when not carrying the buoyant articles, a buoyant handle positioned on a top side of the float, and a pouch connected to the body for holding items.

BRIEF DESCRIPTION OF THE DRAWING FIGURES

The present invention is best understood when the following detailed description of the invention is read with reference to the accompanying drawings, in which.

DETAILED DESCRIPTION OF THE PREFERRED EMBODIMENT

Figure 1:
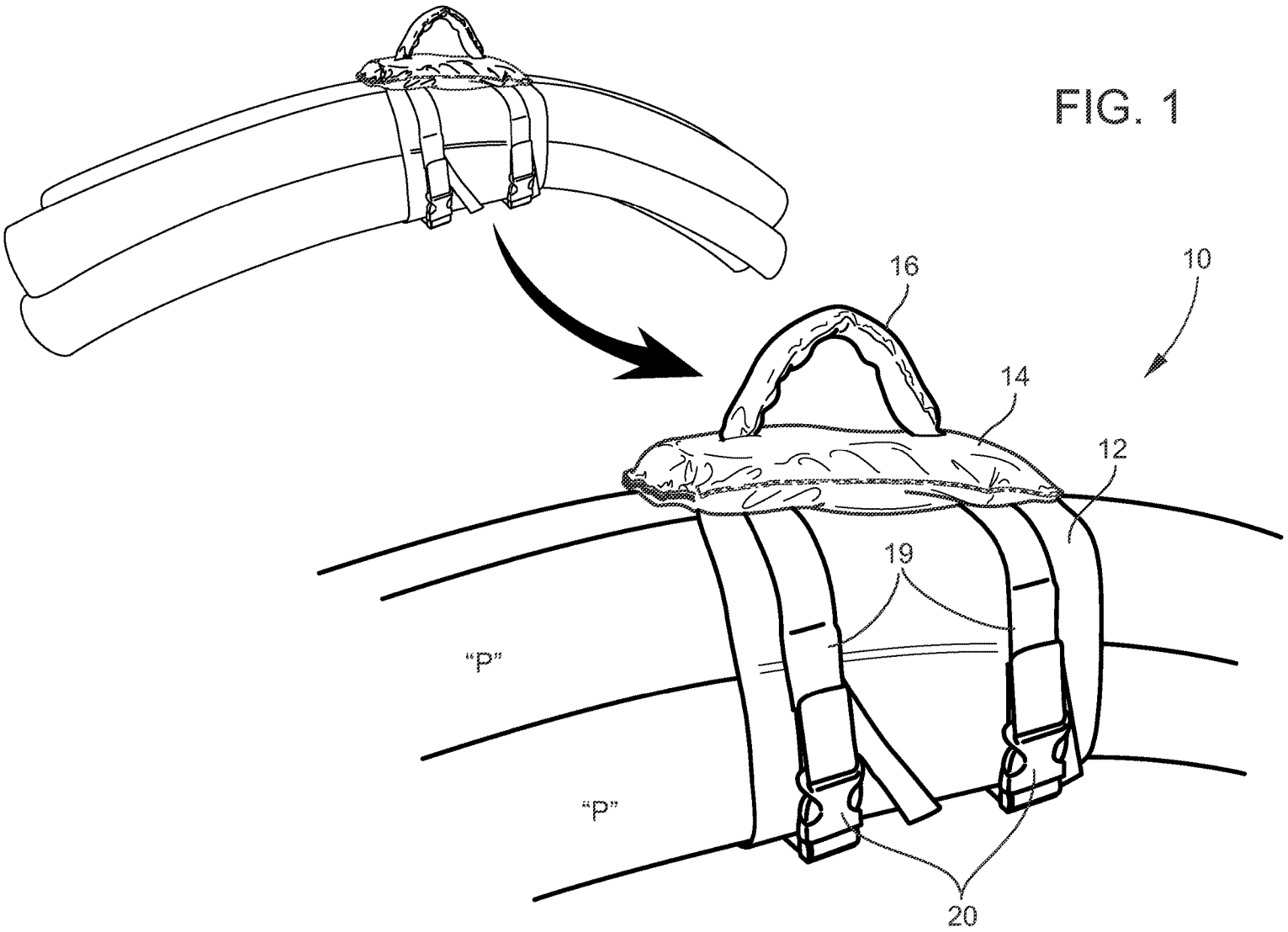
FIG. 1 is a perspective view of the carrier in a fastened state carrying a plurality of pool noodles.
Figure 2:
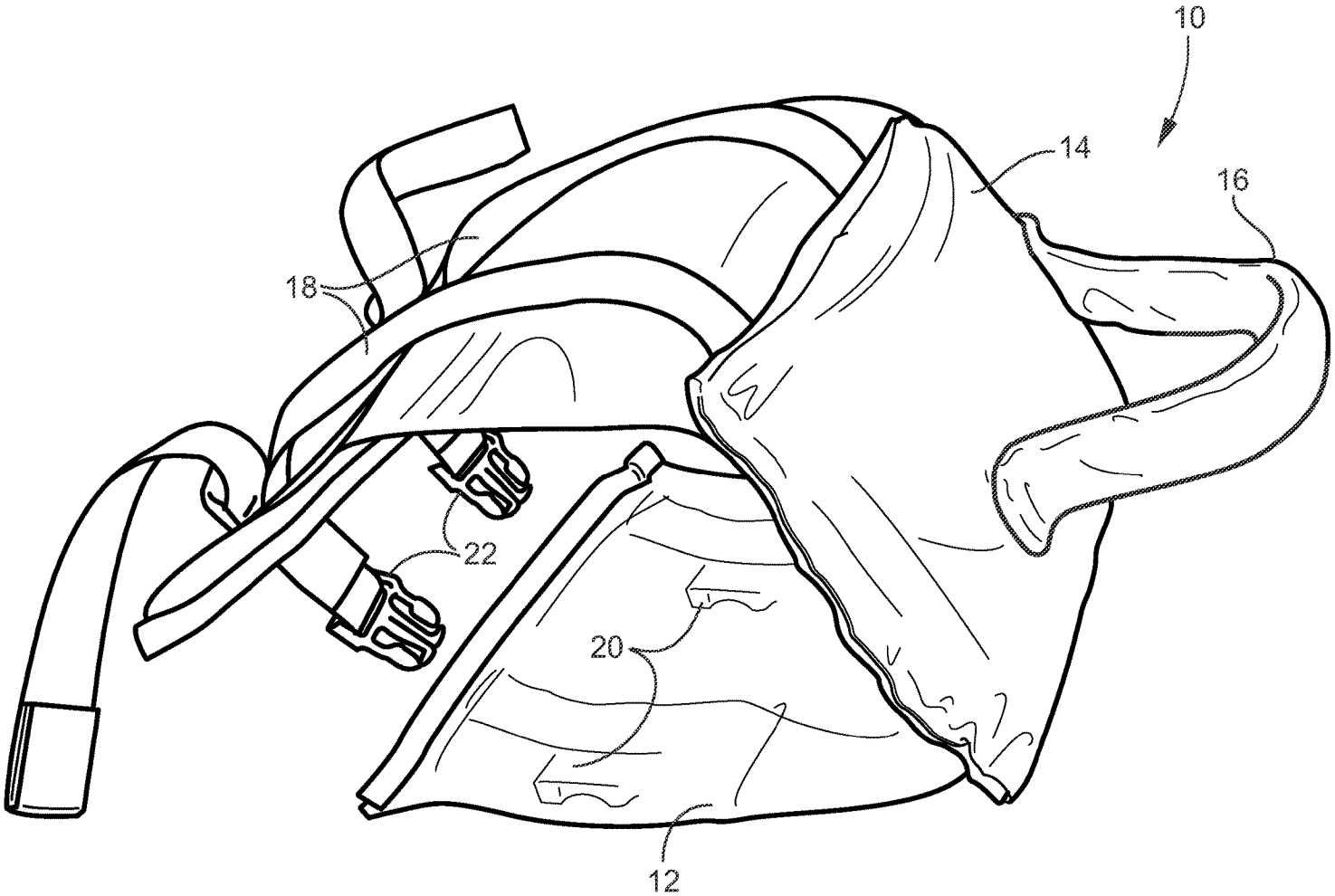
FIG. 2 is a perspective view of the carrier in an unfastened condition.
Figure 3:
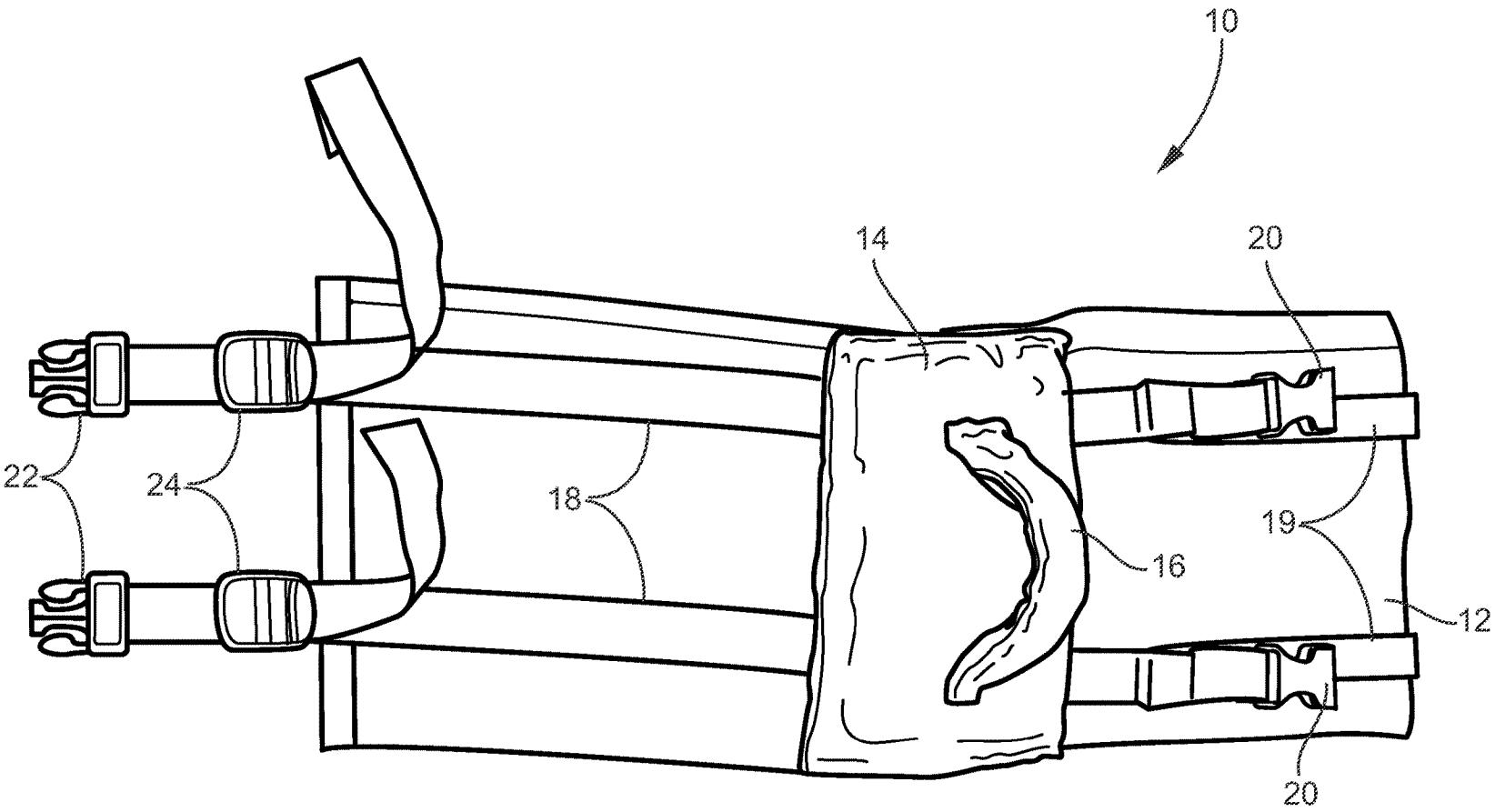
FIG. 3 is a top view of the carrier in an unfastened condition.

Referring now to the figures, FIG. 1-3 show a carrier 10 in the preferred embodiment. The carrier 10 has a body 12 with a float 14 attached to the body 12. The float 14 has a handle 16 ergonomically designed for a human hand to hold. The body 12 of the carrier 10 is a length sufficient to encircle a plurality of pool noodles "P".

The carrier 10 is able to float whether or not pool noodles "P" are contained within the body 12. This is due to buoyancy of the float 14 being sufficient to cause the entire carrier 10 to float. The float 14 is made of plastic foam such as polyvinyl chloride or polyethylene, and optionally be wrapped in a lightweight fabric for protecting the foam or adding aesthetic value to the carrier 10. Other buoyant materials are also envisioned. In addition to the float 14, the body 12 is constructed of a lightweight mesh material that allows for water to pass through the mesh. This mesh body 12 improves the buoyancy of the carrier 10. The body 12 can also be constructed of other materials such as fabrics and plastics. To further improve buoyancy, the handle 16 can be made of a similar buoyant material as the float 14, or a different buoyant material as appropriate.

While the preferred embodiment of the carrier 10 is for carrying pool noodles "P", the carrier 10 is not limited to carrying standard pool noodles. Numerous buoyant articles that have a proportionally longer length when compared to the diameter are envisioned. These buoyant articles can be made of different materials such as foam or plastic, they can be hollow or be solid, can be flexible or rigid, and they can have different cross section shapes and sizes.

As best shown in FIGS. 2 and 3, two pair of straps 18, 19 are connected to the body 12 and have length adjusters 24. The first pair of straps 18 extends in one direction from the float 14 along the length of the body 12, and the other pair 19 extends in the opposite direction from the float 14. Each pair 18, 19 has cooperating respective plastic snap buckles 20, 22. Once the straps 18, 19 are buckled, the body 12 is able to encircle pool noodles "P" such that they can be carried. Other fasteners are also envisioned, such as but not limited to hook and loop (See FIG. 6), buttons, snaps, zippers, hook and closure, and magnets.

Figure 4:
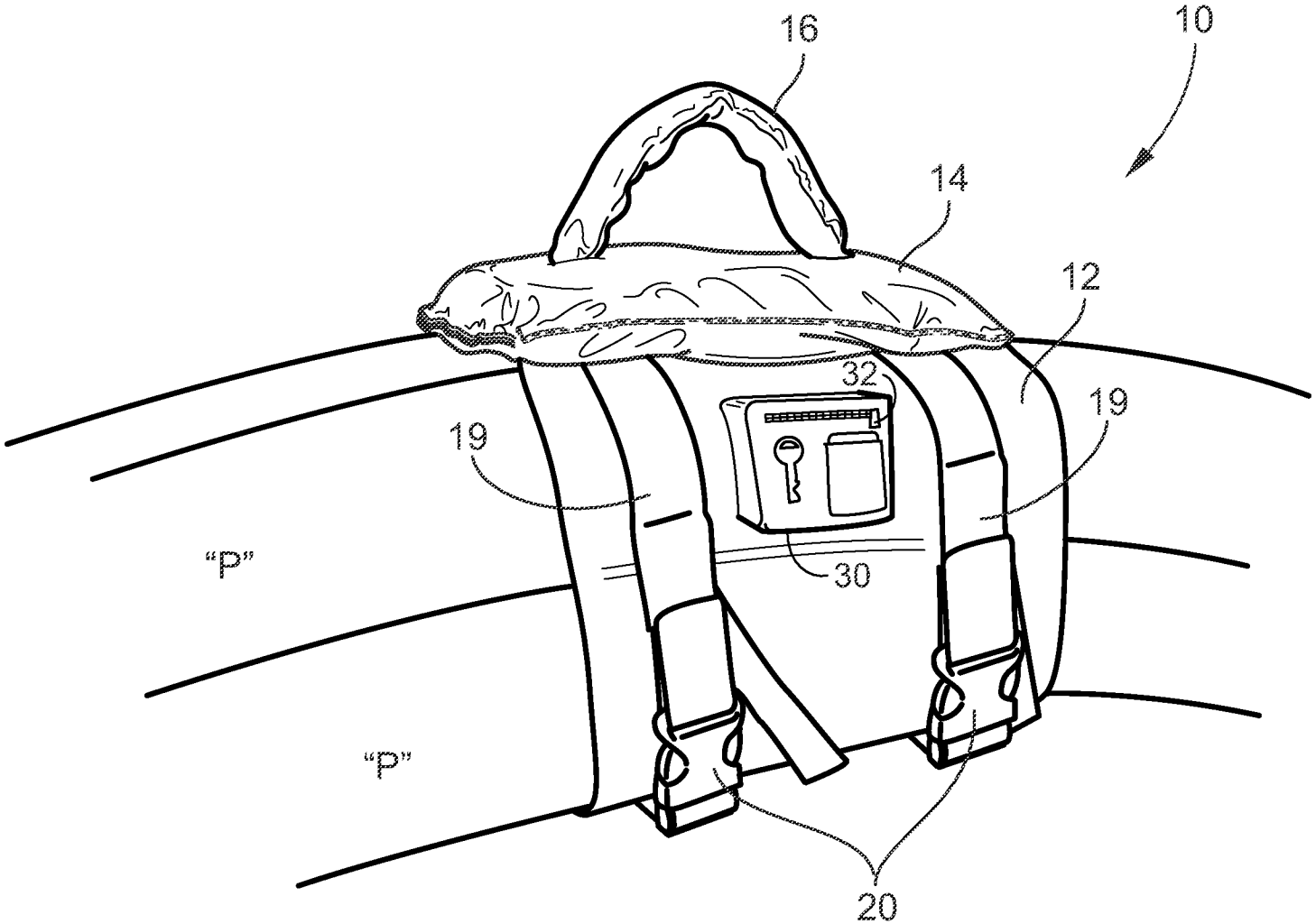
FIG. 4 is a perspective view of one embodiment of the carrier with a pouch on the body.
Figure 5:
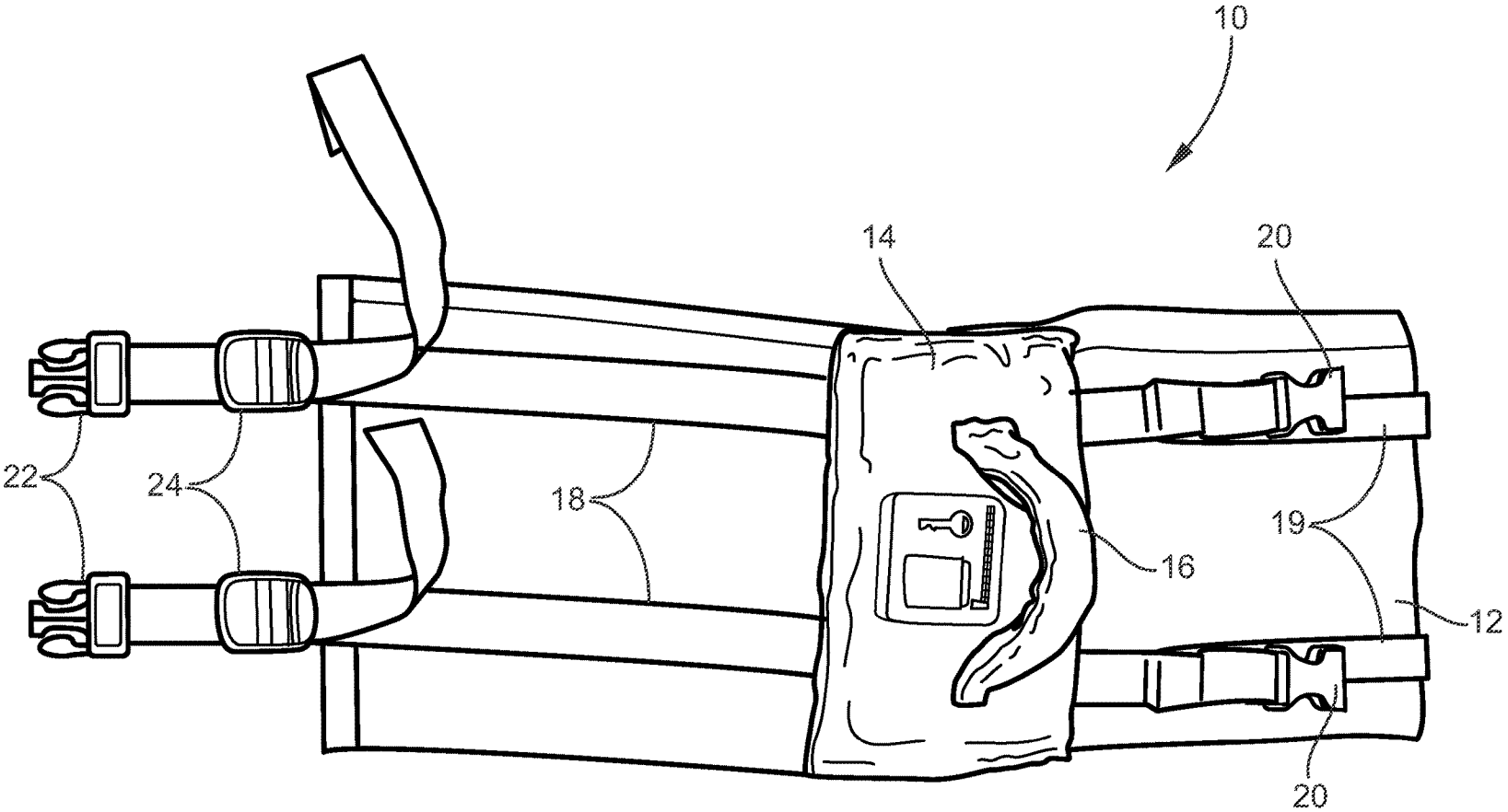
FIG. 5 is a top view of one embodiment of the carrier with a pouch on the float.

FIGS. 4 and 5 show the carrier 10 having a pouch 30 mounted on the body 12 and the float 14 respectively. The pouch 30 is sealable with a zipper 32 and is ideally waterproof. Alternatively the pouch can be sealed by other types of fasteners such as buttons, hook and loop, interlocking groove and ridge, and draw strings. The pouch 30 can be mounted anywhere along the length of the body 12. Additionally, the carrier 10 can include multiple pouches 30 of varying sizes. Sizing of the pouch 30 can vary depending on the desired item to be stored inside from smaller relative sized pouches 30 for house keys to larger relative sized pouches 30 capable of storing a mobile phone. Typical items that the pouch 30 can be sized for include, but are not limited to house keys, vehicle keys, identification, bank cards, and mobile phones.

Figure 6:
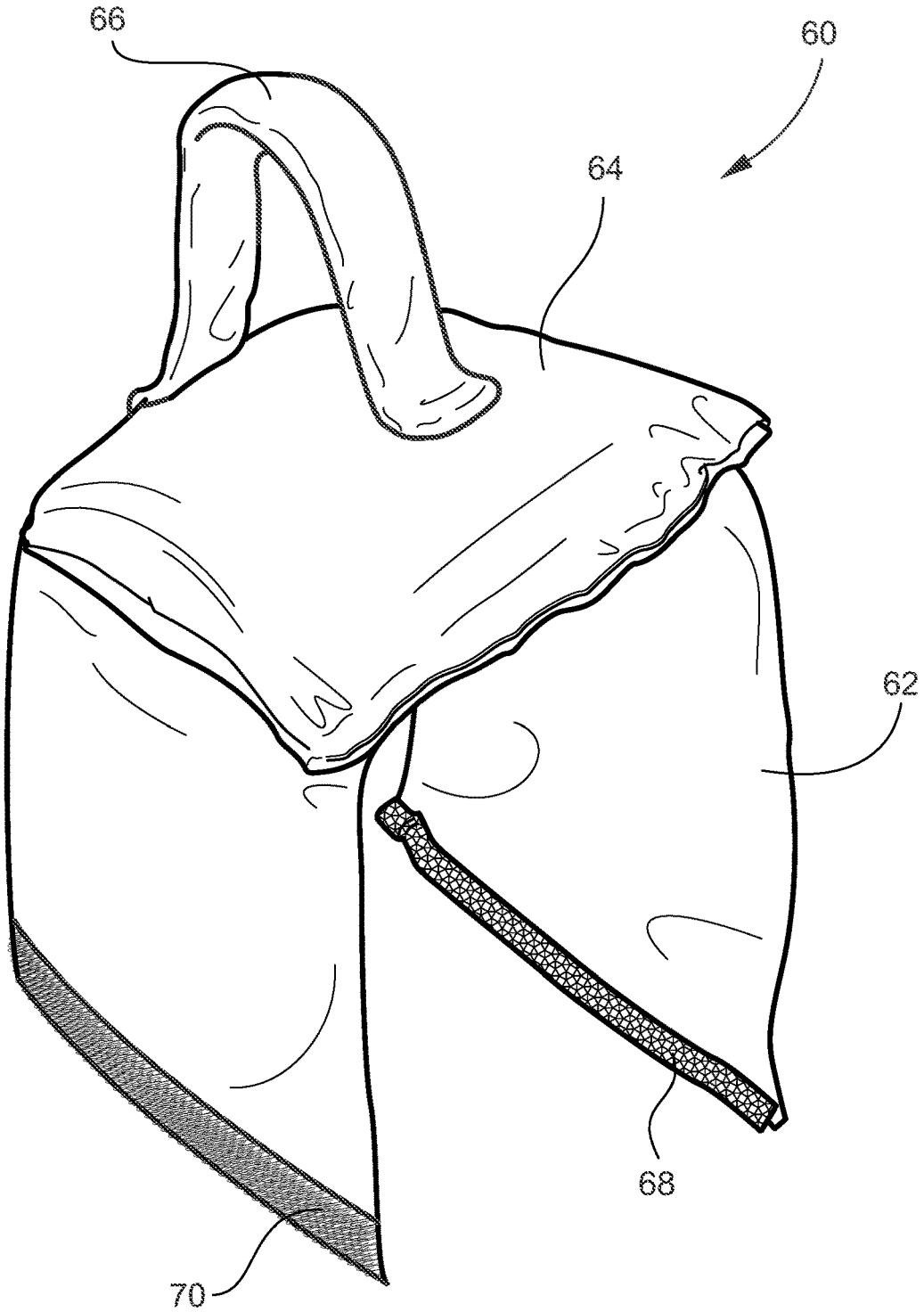
FIG. 6 is a perspective view of one embodiment of the carrier with a hook and loop fastening system.

FIG. 6 shows an alternative embodiment of the carrier 60 with a body 62, a float 64, a handle 66, and cooperating hook and loop strips 68, 70. The hook and loop strips 68, 70 are attached to opposing ends of the body 62. One strip 68 is attached on an inside of the body 62 and the other strip 70 is attached on an outside of the body 62 such that they are able to fasten the body 62 around the pool noodles.

A device for carrying long, flexible buoyant articles according to the invention has been described with reference to specific embodiments and examples. Various details of the invention may be changed without departing from the scope of the invention. Furthermore, the foregoing description of the preferred embodiments of the invention and best mode for practicing the invention are provided for the purpose of illustration only and not for the purpose of limitation, the invention being defined by the claims.

What is claimed is:

1. A carrier for transporting and storing elongate, flexible, buoyant articles, comprising:

(a) a body having a pre-determined length and a pre-determined width, the length of the body adapted to encircle a central portion of the plurality of buoyant articles with opposing distal portions of the plurality of buoyant articles extending outwardly away from the body;

(b) a fastener cooperating with the body for releasably maintaining the body in an encircled position relative to the plurality of the buoyant articles;

(c) a float connected to the body for providing buoyancy to the carrier when not carrying the buoyant articles, and having a handle positioned on a top side of the float;

(d) the body, when fastened, having two open ends defining a tubular-like through passageway;

(e) the float having a length less than the pre-determined length of the body; and (f) at least a portion of the body including an open mesh for allowing easy water penetration and drainage.

2. The carrier for buoyant articles according to claim 1, wherein the float has a width equal to the width of the body.

3. The carrier for buoyant articles according to claim 1, wherein the pre-determined length is at least twice the pre-determined width.

4. The carrier for buoyant articles according to claim 1, wherein the float is positioned at a length-wise center of the body.

5. The carrier for buoyant articles according to claim 1, wherein the handle is at least partially made of a buoyant material.

6. The carrier for buoyant articles according to claim 1, wherein the mesh is a lightweight open mesh for allowing easy water penetration and drainage.

7. The carrier for buoyant articles according to claim 1, wherein the fastener is an adjustable strap connected to the body.

8. The carrier for carrying buoyant articles according to claim 1, wherein the fastener is a hook and loop fastener.

9. The carrier for buoyant articles according to claim 1, wherein the body further comprises a pouch for holding items.

10. The carrier for buoyant articles according to claim 1, wherein the float further comprises a pouch for holding items.

11. A carrier for transporting and storing elongate, flexible, buoyant articles, comprising:

(a) a body having a pre-determined length and a pre-determined width, and adapted to encircle the plurality of buoyant articles;

(b) a fastener cooperating with the body for releasably maintaining the body in an encircled position relative to the plurality of the buoyant articles;

(c) a float connected to the body for providing buoyancy to the carrier when not carrying the buoyant articles;

(d) wherein a pouch is positioned on the float for holding items.

12. The carrier for buoyant articles according to claim 11, wherein the float includes a handle positioned on a top side of the float.

13. The carrier for buoyant articles according to claim 12, wherein the handle is at least partially made of a buoyant material.

14. The carrier for buoyant articles according to claim 11, wherein the body is a lightweight open mesh for allowing easy water penetration and drainage.

15. The carrier for buoyant articles according to claim 11, wherein the fastener is an adjustable strap connected to the body.

16. The carrier for carrying buoyant articles according to claim 11, wherein the fastener is a hook and loop fastener.

17. A carrier for transporting and storing elongate, flexible, buoyant articles, comprising:

(a) a mesh body;

(b) a float positioned on the mesh body having predetermined lengths of the mesh body extending from opposing sides of the float;

(c) a handle positioned on a top side of the float; and (d) a fastener cooperating with the mesh body for releasably forming a tubular-like through passageway with two open ends for holding the plurality of buoyant articles when the carrier is fastened.

* * * * *